US010894279B2

(12) United States Patent
Hertel et al.

(10) Patent No.: US 10,894,279 B2
(45) Date of Patent: Jan. 19, 2021

(54) DESCALING DEVICE

(71) Applicant: HAUHINCO MASCHINENFABRIK G. HAUSHERR, JOCHUMS GMBH & CO. KG, Sprockhövel (DE)

(72) Inventors: Udo Hertel, Schwerte (DE); Dirk Schulze Schencking, Wuppertal (DE)

(73) Assignee: HAUHINCO MASCHINENFABRIK G. HAUSHERR, JOCHUMS GMBH & CO. KG, Sprockhövel (DE)

( * ) Notice: Subject to any disclaimer, the term of this patent is extended or adjusted under 35 U.S.C. 154(b) by 90 days.

(21) Appl. No.: 16/144,310

(22) Filed: Sep. 27, 2018

(65) Prior Publication Data

US 2019/0099791 A1 Apr. 4, 2019

(30) Foreign Application Priority Data

Sep. 29, 2017 (DE) ..... 10 2017 122 802

(51) Int. Cl.
*B21B 45/04* (2006.01)
*B08B 7/02* (2006.01)
(Continued)

(52) U.S. Cl.
CPC ..... *B21B 45/04* (2013.01); *B05B 1/14* (2013.01); *B05B 3/027* (2013.01);
(Continued)

(58) Field of Classification Search
CPC ..... B21B 45/04; B21B 45/08; B05B 13/0484; B05B 1/14; B05B 3/027; B05B 13/0421; B08B 3/022; B08B 7/024; Y10T 29/45; Y10T 29/4528; Y10T 29/4561; Y10T 29/479; Y10T 29/4544
See application file for complete search history.

(56) References Cited

U.S. PATENT DOCUMENTS 3,850,373 A 11/1974 Grolitsch
5,088,362 A 2/1992 Schalles
(Continued)

FOREIGN PATENT DOCUMENTS

DE 4328303 A1 6/1994
DE 102015226657 A1 6/2017
WO 2016162222 A1 10/2016

*Primary Examiner* — Sarang Afzali
(74) *Attorney, Agent, or Firm* — David S. Safran; Roberts Calderon Safran & Cole, P.C.

(57) ABSTRACT

A descaling device having a device housing, a shaft, a shaft bearing, a nozzle head and a medium coupling, wherein the shaft bearing is arranged in the device housing and the shaft is mounted in the device housing by the shaft bearing for carrying out a rotary movement, wherein the shaft and the nozzle head are detachably connected to one another in a non-destructive manner, wherein the medium coupling has a medium connection for supply of a medium, wherein the shaft has a shaft cavity for conducting the medium supplied at the medium connection to the nozzle head. The descaling device has an improved maintainability and reliability due to the descaling device having a motor, and due to the motor being arranged on the shaft in the device housing between the nozzle head and the medium coupling in order to generate the rotary movement of the shaft.

9 Claims, 3 Drawing Sheets

(51) Int. Cl.

| | |
|---|---|
| ***B21B 45/08*** | (2006.01) |
| ***B05B 13/04*** | (2006.01) |
| ***B05B 1/14*** | (2006.01) |
| ***B05B 3/02*** | (2006.01) |
| ***B08B 3/02*** | (2006.01) |

(52) U.S. Cl.
CPC ..... *B05B 13/0421* (2013.01); *B05B 13/0484* (2013.01); *B08B 3/022* (2013.01); *B08B 7/024* (2013.01); *B21B 45/08* (2013.01); *Y10T 29/4528* (2015.01); *Y10T 29/4544* (2015.01)

(56) References Cited

U.S. PATENT DOCUMENTS

| | | | | |
|---|---|---|---|---|
| 5,402,936 | A | 4/1995 | Hammelmann | |
| 2015/0143822 | A1* | 5/2015 | Chalmers ..... | F04D 1/06 62/50.6 |

* cited by examiner

DESCALING DEVICE

BACKGROUND OF THE INVENTION

Field of the Invention

The invention relates to a descaling device having a device housing, a shaft, a shaft bearing, a nozzle head and a medium coupling. The shaft bearing is arranged in the device housing and the shaft is mounted in the device housing by the shaft bearing for carrying out a rotary movement. The shaft and the nozzle head are detachably connected to one another in a non-destructive manner. The medium coupling has a medium connection for supply of a medium and the shaft has a shaft cavity for conducting the medium supplied at the medium connection to the nozzle head.

Description of Related Art

Usually several such descaling devices belong to a scale washer. In particular, a scale washer also has a high-pressure generation device. A high-pressure generating device places a medium under a pressure of approx. 200 bar to 420 bar. This medium is, for example, water. A scale washer is usually part of a hot working device which forms heated workpieces. Heating serves to improve formability. Such hot working devices are, for example, hot rolling mills and forging presses. The temperature of a hot workpiece during hot working is often higher than the recrystallization temperature of the workpiece. The heat of the workpiece causes scale to form on its surface. Scale is an impurity of iron oxide. Scale that sprouts immediately after heating a workpiece is particularly persistent compared to scale produced at a later point in time and is referred to as primary scale. Scale not removed from a workpiece is detrimental to that workpiece.

A medium pressurized by the high-pressure generating device is supplied to a descaling device at the medium connection of the medium coupling. The medium coupling directs the supplied medium from the medium connection into the shaft cavity of the shaft. The shaft cavity then directs the medium to the nozzle head. The nozzle head converts the pressure into kinetic energy and expels the medium in the direction of the workpiece. Essentially, the kinetic energy of the medium causes the scale to be removed from the surface of the workpiece when the medium hits the surface of the workpiece. The removal of scale from a surface is also referred to as descaling. The effectiveness of descaling depends on the speed of the medium and thus on the pressure of the medium and the distance of the nozzle head from the workpiece. For this reason, the medium is put under as high a pressure as possible on the one hand and the nozzle head is arranged as close as possible to the workpiece on the other.

In order to improve the efficiency of descaling, the nozzle head together with the shaft carries out the rotary movement given by the shaft bearing. The shaft is driven by a motor arranged separately from the descaling device via further drive components.

A descaling device of the type described and also a descaling breaker are known, for example, from the German Patent DE 43 28 303 C2.

Although a single separately arranged motor allows several descaling devices to be driven, the other drive components between the motor and the descaling device—as well as the motor and the descaling device—require maintenance, reduce reliability, require installation space, make adaptation to an application such as a hot rolling mill more difficult and, in particular by arranging the other drive components on the motor and the descaling device, make maintenance of the motor and the descaling device more difficult. Maintenance includes, in particular, determining wear and replacement when the wear has reached a certain level.

SUMMARY OF THE INVENTION

The object of the present invention is, thus, to provide a descaling device of the type described, which in any case minimizes at least one of the disadvantages described.

The object is achieved by a descaling device as described herein that has a motor which is arranged on the shaft in the device housing between the nozzle head and the medium coupling in order to generate the rotary movement of the shaft.

This arrangement of the motor means that the other drive components for transferring the rotary motion from a separately arranged motor to the shaft of a descaling device are no longer required. This also eliminates the need to maintain these components, increases reliability, facilitates adaptability and simplifies maintenance of the descaling device, particularly by improved accessibility due to the elimination of other drive components. The descaling device is also more compact than prior art descaling devices and allows a modular design of a scale washer.

The descaling device is located in the immediate vicinity of a hot workpiece in a hot working device. Thus, it is also exposed to the environmental influences of the hot working device. These environmental influences include, in particular, high temperatures, moisture and particles such as removed, i.e. detached, scale. For this reason, a design of the descaling device according to the invention provides for the device housing to hermetically enclose the motor. The hermetic enclosure of the motor ensures that the motor itself is protected from environmental influences. In particular, the device housing is designed in such a manner that no particles and preferably no descaling medium can penetrate it.

In a further design it is provided that the motor is designed as an electric motor. An electric motor fundamentally has a motor shaft, a rotor arranged on the motor shaft, a motor housing, a stator arranged in the motor housing and a motor shaft bearing for mounting the motor shaft in the motor housing. When electrical energy is supplied, magnetic fields act between the rotor and the stator, which exert a torque on the rotor that the rotor transfers to the motor shaft. In the present design of the descaling device, the device housing is also designed as a motor housing, the shaft also as a motor shaft and the shaft bearing also as a motor shaft bearing. The stator is arranged in the device housing and the rotor on the shaft. Thus, the rotary motion of the shaft during operation of the descaling device is effected directly by the electric motor, i.e. without further drive components.

Investigations have shown that for the effectiveness of the descaling of a workpiece, advantageous speeds of rotation of the nozzle head lie in the range between 500 rpm and 600 rpm. If alternating current with a frequency between 50 Hz and 60 Hz is available to supply the electric motor with electrical energy, an asynchronous motor with six pole pairs is particularly suitable as an electric motor. The shaft of an asynchronous motor with six pole pairs has a speed of 500 rpm when supplied with energy by an alternating current of 50 Hz and a speed of 600 rpm when supplied with an alternating current of 60 Hz.

In a further design of the descaling device, it is provided that the shaft does not consist of a single workpiece but has a first partial shaft and a second partial shaft, wherein the first partial shaft and the second partial shaft are detachably connected to one another in a non-destructive manner. Preferably, the shaft consists only of the first and second partial shafts. A first component, e.g., the first partial shaft, and a second component, e.g. the second partial shaft, are detachably connected to one another in a non-destructive manner if, after the components have been detached from each other, they are unchanged in comparison to the connected state. This implies, in particular, that it is possible to reconnect the components without further ado. A non-destructive, detachable connection between the first and second partial shafts is achieved, for example, by a thread in the first partial shaft along a longitudinal axis of the first partial shaft and a thread complementary to this thread in the second partial shaft along a longitudinal axis of the second partial shaft. Hence, the first and second partial shafts can be easily and detachably connected to one another in a non-destructive manner by screwing them together and detached from one another in a non-destructive manner unscrewing. For sealing between the first and the second partial shaft, a sealing device is preferably also provided in the connection. This sealing device is, for example, at least one annular seal.

In this design, it is further provided that the first partial shaft is connected to the nozzle head, the shaft bearing is arranged exclusively on the first partial shaft and the medium coupling is arranged on the second partial shaft. The medium coupling is arranged at the shaft, namely at the second partial shaft, whereby the shaft and the medium coupling have a contact surface. Due to the rotary motion of the shaft in the medium coupling, the shaft and the medium coupling wear at this contact surface. With the present design, when the wear of the shaft at the contact surface has reached a critical level, it is no longer necessary to replace the shaft, but only the second partial shaft, without having to involve the shaft bearing.

In a further development of the above design, it is provided that the first and second partial shafts each have a blind hole with one open end and one closed end. The blind hole of the first partial shaft and the blind hole of the second partial shaft together form the shaft cavity. Accordingly, the closed end of the first partial shaft is arranged at the nozzle head and the closed end of the second shaft is arranged at the medium coupling. Thus the shaft is closed at its ends by the closed ends of the blind holes. In descaling devices known from prior art, at least one end of the shaft is often closed with a screw. However, closing one end of a shaft with a screw is disadvantageous, as the medium supplied during operation of a descaling device has strong pressure fluctuations which exert a pulsating force in the longitudinal direction on the screw, loosening the screw and allowing the medium to escape from the end of the shaft.

In a further design of the descaling device, it is provided that the medium coupling has a coupling housing, a cover and a sealing device. The coupling housing has a coupling cavity and the cover connected in non-destructive, detachable manner seals the coupling cavity. The non-destructive, detachable connection between the cover and the coupling housing is achieved, for example, by a screw connection with at least one screw, wherein the thread for the at least one screw is designed in the coupling housing. The at least one screw is unscrewed from the thread for demounting the cover and the at least one screw is screwed into it for mounting. The sealing device is inserted in the coupling cavity for sealing between the shaft and the medium connection. The sealing device therefore ensures that a medium supplied into the medium connection is fed into the shaft cavity and does not escape, for example, between the shaft and the coupling housing. Furthermore, the medium coupling and the shaft are designed in such a manner that the sealing device can be removed and inserted when the cover is removed. This means that the sealing device can, on the one hand, be pulled out of the shaft cavity and pushed into the shaft cavity and, on the other hand, pulled off the shaft and pushed onto the shaft. The design of the medium coupling refers in particular to the coupling housing and the sealing device. The design of the medium coupling and the shaft, for example, is such that both the coupling cavity and the shaft each have the shape of a vertical circular cylinder and the sealing device is limited by the outer shape of a hollow cylinder which is adapted to the coupling cavity and to the shaft in the coupling cavity. The sealing device preferably consists of several sealing elements. Thus, this design allows easy removal and insertion of the sealing device.

In this design, the previously described contact surface between the shaft and the medium coupling is located between the shaft and the sealing device, which is part of the medium coupling. The rotary motion of the shaft in the sealing device causes the shaft and sealing device to wear at the contact surface. With the present design, it is possible, on the one hand, to check the sealing device after simply removing it from the coupling housing and, on the other hand, if the wear of the sealing device at the contact surface has reached a critical level, it is also possible to easily replace the sealing device.

In a further development of the previously described design of the descaling device, it is provided that the coupling housing is separate from the device housing and that the coupling housing and the device housing are detachably connected to one another in a non-destructive manner. The non-destructive, detachable connection between the coupling housing and the device housing is, for example, implemented by a screw connection with at least one screw, wherein the thread for the at least one screw is formed in the device housing. To demount the coupling housing, the at least one screw is unscrewed and for mounting, the at least one screw is screwed in. This further development enables the coupling housing to be demounted from the device housing, after which the part of the shaft with the contact surface is freely accessible. This makes it possible to check the contact surface of the shaft in an advantageous manner.

If the shaft has a first partial shaft and a second partial shaft and the medium coupling is arranged on the second partial shaft, then a preferred further development of the further development described above is given in that the coupling housing is designed and arranged on the device housing in such a manner that, when the coupling housing is demounted, the second partial shaft can be demounted from the first partial shaft and mounted on the first partial shaft. The second partial shaft can then be demounted from the first partial shaft if the connection between the second partial shaft and the first partial shaft is detachable and connectable when the coupling housing is demounted. In this further development, it is possible to check the contact surface at the shaft in an advantageous manner and, if the wear of the shaft at the contact surface has reached a critical level, it is also possible to replace the shaft in an advantageous manner.

During operation of the descaling device, a hot workpiece is in front of the nozzle head and the motor is in operation and generates the rotary motion of the shaft. The heat generated in the motor during motor operation by the motor and, in particular, the radiant heat of the workpiece must be dissipated so that the descaling device does not overheat. For this reason, a design of the descaling device provides that cooling channels are formed in the device housing and that the device housing is further designed in such a manner that the heat from the motor and/or radiant heat from a workpiece, in particular in front of the nozzle head, is transferred to a medium present in the cooling channels. In particular, cooling channels are formed in the part of the device housing that comes closest to the hot workpiece. Alternatively or additionally, it is provided in a further design that the motor itself is designed to transfer the heat generated by the motor during motor operation to a medium present in the shaft cavity. The design of the motor is given, for example, when the thermal conductivity of the motor is sufficiently high so that the heat is sufficiently transferred to the medium. This is often the case with an electric motor.

The nozzle head of the descaling device is arranged as close as possible to the workpiece in order to achieve the highest possible descaling efficiency and expels a descaling medium onto the surface of the workpiece coated with scale. As a result, the scale is blasted off the surface of the workpiece and also hits the nozzle head, which is subject to wear due to the impact of the scale. For this reason, it is provided in a further design that the nozzle head has a nozzle head carrier and a nozzle carrier. There is at least one nozzle for expelling a medium in the nozzle carrier and there is at least one channel in the nozzle head carrier for guiding the medium from the shaft cavity to the at least one nozzle. Furthermore, the nozzle carrier and the nozzle head carrier are detachably connected to one another in a non-destructive manner and the nozzle head carrier and the shaft are connected to one another. Accordingly, the nozzle carrier is arranged in front of the nozzle head carrier in relation to the workpiece and the nozzle carrier experiences wear due to the scale. The non-destructive, detachable connection between the nozzle head and the nozzle head carrier is implemented, for example, by a screw connection with at least one screw, whereby the thread for the at least one screw is formed in the nozzle head carrier. To remove the nozzle head, the at least one screw is unscrewed and for mounting, the at least one screw is screwed in. With the present design, it is no longer necessary to replace the entire nozzle head when a critical degree of wear has been reached; it is sufficient to replace the nozzle carrier.

In detail, there are numerous possibilities for designing and further developing the descaling device as will be apparent from the following description of a preferred embodiment in conjunction with the accompanying drawings.

DETAILED DESCRIPTION OF THE INVENTION

Figure 1:
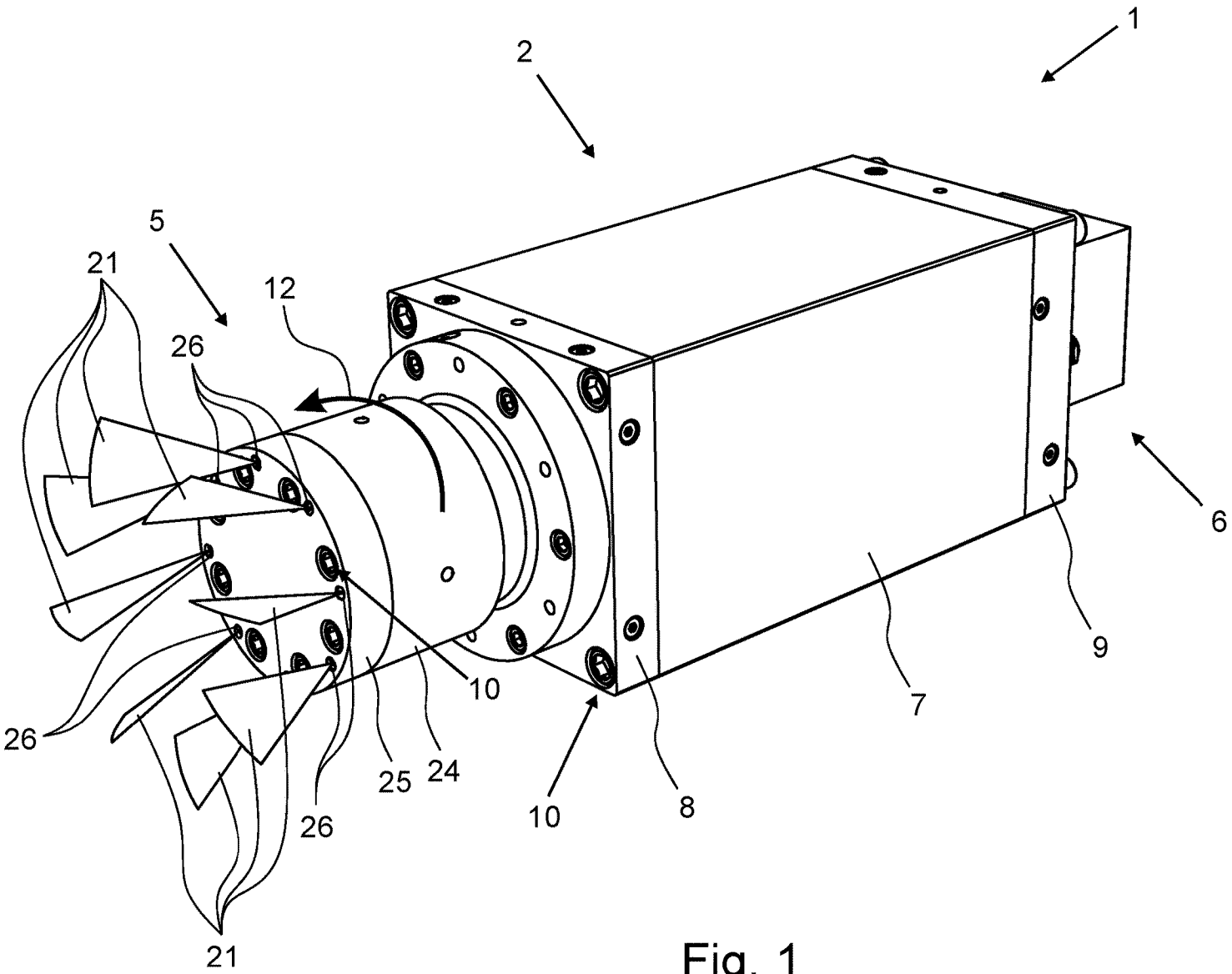
FIG. 1 is a perspective view of an embodiment of a descaling device in accordance with the invention.
Figure 2:
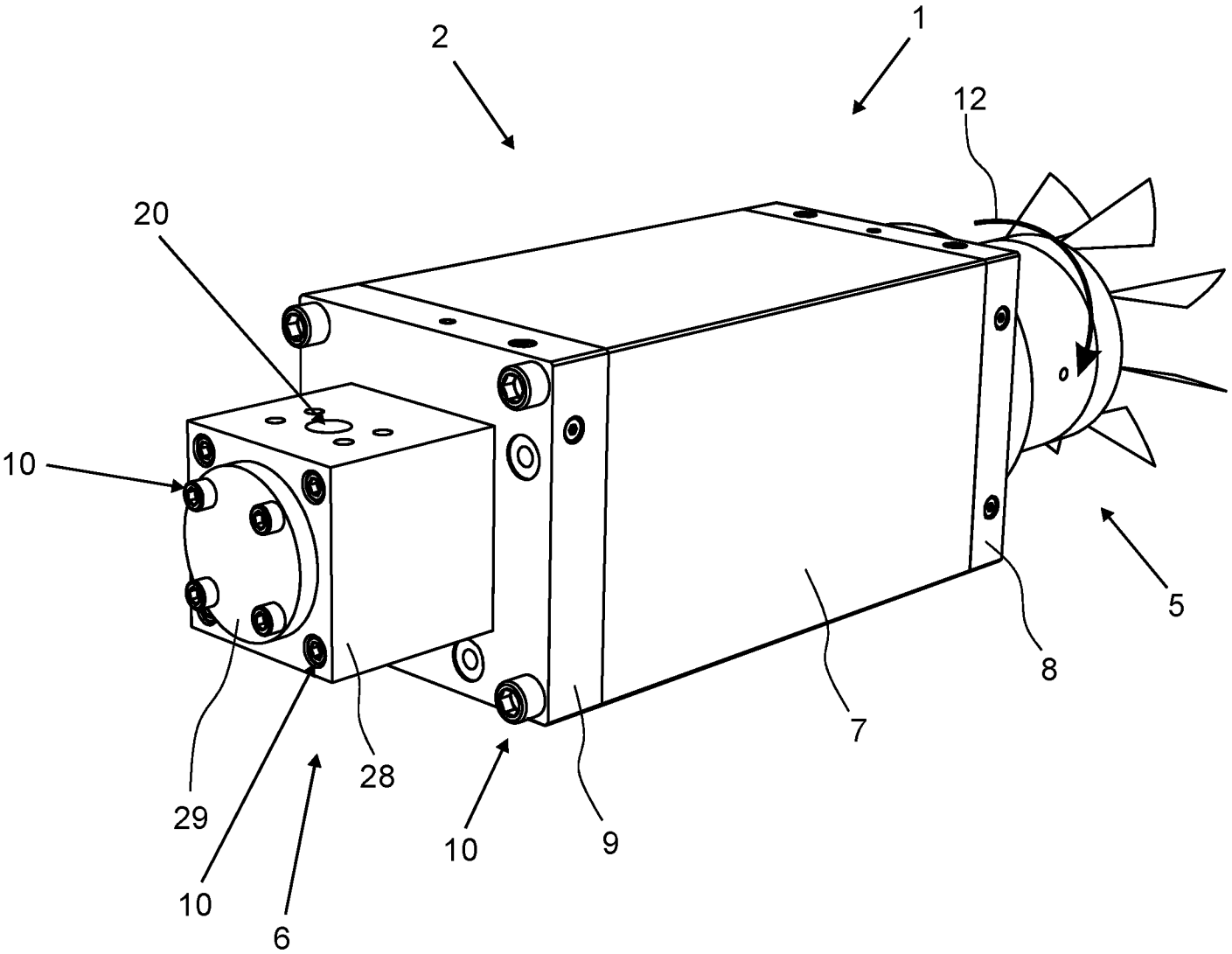
FIG. 2 is a second perspective view of the embodiment shown in FIG. 1.
Figure 3:
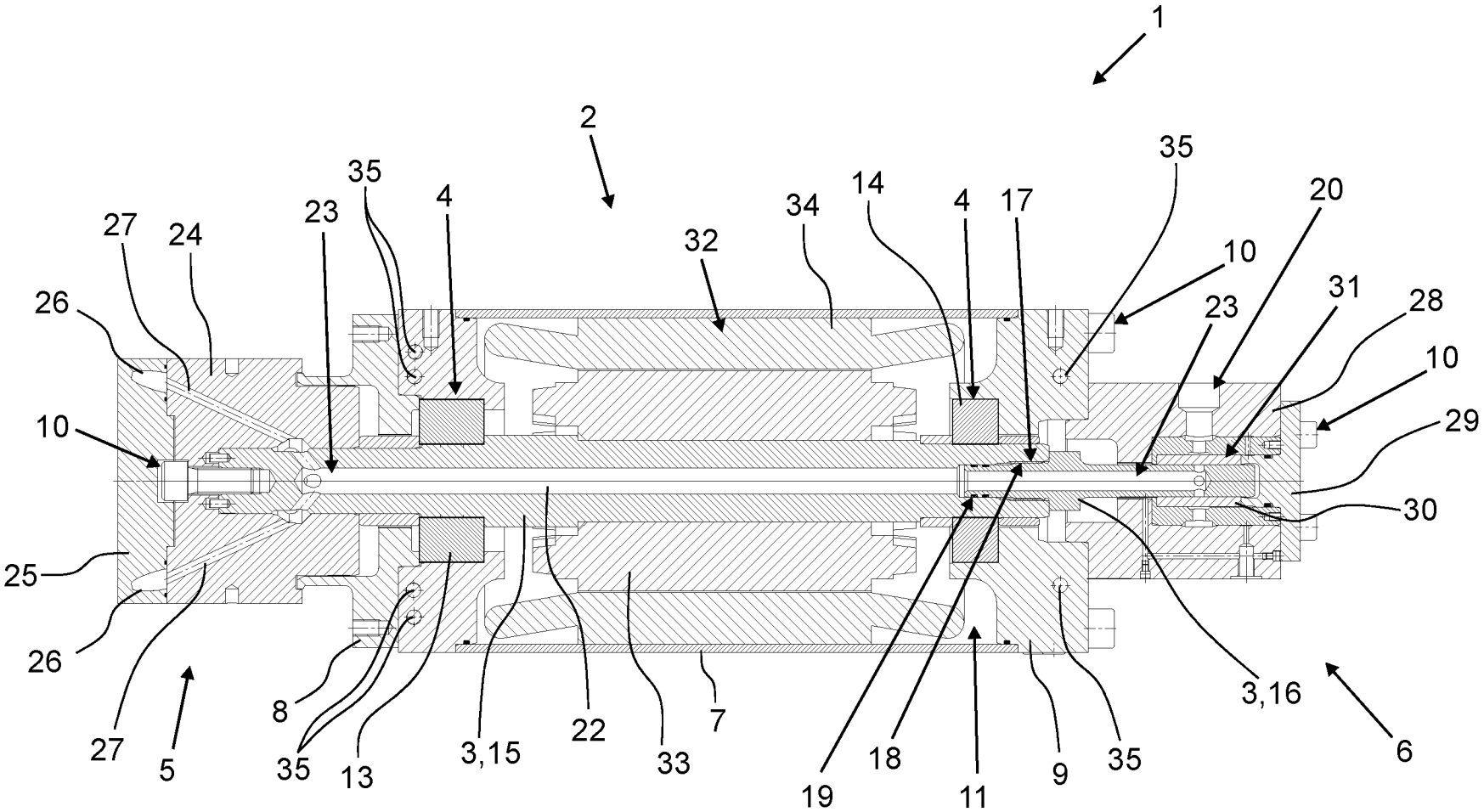
FIG. 3 is a longitudinal cross-sectional view of the embodiment shown in FIG. 1.

In a first perspective illustration, FIG. 1 shows an embodiment of a descaling device 1. FIG. 2 shows the embodiment in a second perspective illustration and FIG. 3 shows a longitudinal cross-section of the embodiment.

The descaling device 1 has a device housing 2, a shaft 3, a shaft bearing 4, a nozzle head 5 and a medium coupling 6.

The device housing 2 comprises a housing middle segment 7, a first housing end segment 8 and a second housing end segment 9. The housing middle segment 7 is hollow cylindrical and the first housing end segment 8 and the second housing end segment 9 are plate-shaped. The housing middle segment 7 is connected to each of the first housing end segment 8 on the one hand and to the second housing end segment 9 on the other hand by four screw connections 10. Each screw connection 10 comprises one screw and one thread. Thus, the screw connections 10 are detachable in a non-destructive manner and can also be reconnected. The total of eight threads are formed in the housing middle segment 7. The housing middle segment 7, the first housing end segment 8 and the second housing end segment 9 together form a housing interior 11.

The shaft bearing 4 is arranged in the device housing 2 and the shaft 3 is mounted in the device housing 2 by the shaft bearing 4 for a rotary movement 12. The shaft bearing 4 comprises a first bearing 13 which is arranged in the first housing end segment 8 and a second bearing 14 which is arranged in the second housing end segment 9.

The shaft 3 is formed of a first partial shaft 15 and a second partial shaft 16. The first partial shaft 15 and the second partial shaft 16 are detachably connected to one another in a non-destructive manner. The connection between the first partial shaft 15 and the second partial shaft 16, which can be detached in a non-destructive manner and also reconnected, is implemented by a first partial shaft thread 17 in the first partial shaft 15 along a longitudinal axis of the first partial shaft 15 and a second partial shaft thread 18 complementary to the first partial shaft thread 17 in the second partial shaft 16 along a longitudinal axis of the second partial shaft 16. For sealing between the first partial shaft 15 and the second partial shaft 16, a partial shaft seal 19 is arranged between the first partial shaft 15 and the second partial shaft 16. The partial shaft seal 19 comprises two annular seals. The shaft 3 is connected to the nozzle head 5 in a non-destructive, detachable manner by the first partial shaft 15. Furthermore, the shaft bearing 4 is arranged exclusively on the first partial shaft 15 and the medium coupling 6 is arranged exclusively on the second partial shaft 16. The medium coupling 6 has a medium connection 20 for the supply of a medium 21.

The shaft 3 has a shaft cavity 22 for conducting the medium 21 supplied at the medium connection 20 to the nozzle head 5. The first partial shaft 15 and the second partial shaft 16 each have a blind hole 23 with one open end and one closed end. The blind hole 23 of the first partial shaft 15 and the blind hole 23 of the second partial shaft 16 together form the shaft cavity 22.

The nozzle head 5 has a nozzle head carrier 24 and a nozzle carrier 25. Eight nozzles 26 for expelling the medium 21 are arranged in the nozzle carrier 25. The jet pattern of the expelled medium 21 is fan-shaped. Eight channels 27 are designed in the nozzle head carrier 24 to direct the medium 21 from the shaft cavity 22 to the eight nozzles 26. The nozzle carrier 25 and the nozzle head carrier 24 are detachably connected to one another in a non-destructive manner. The connection is made by eight screw connections 10, wherein the corresponding threads are formed in the nozzle head carrier 24. The nozzle head carrier 24 and the shaft 3, in the form of the first partial shaft 15, are also detachably connected in a non-destructive manner. Here the connection is made by a screw connection 10, wherein the corresponding thread is formed in the first partial shaft 15.

The medium coupling 6 has a coupling housing 28, a cover 29 and a sealing device 30. The coupling housing 28 also has a coupling cavity 31, which is sealed by the cover 29, which is detachably connected to the coupling housing 28 in a non-destructive manner. The cover 29 is connected to the coupling housing 28 by four screw connections, wherein the corresponding threads are formed in the coupling housing 28. The sealing device 30 is inserted into the coupling cavity 31 for sealing between the shaft 3, in the form of the second partial shaft 16, and the medium connection 20. The medium coupling 6 and the shaft 3, in the form of the second partial shaft 16, are designed in such a manner that the sealing device 30 can be removed and inserted when the cover 29 is demounted. The design of the medium coupling 6 and the second partial shaft 16 is such that both the coupling cavity 31 and the second partial shaft 16 each have the shape of a vertical circular cylinder and the sealing device 30 is limited by the outer shape of a hollow cylinder that is adapted to the coupling cavity 31 and to the second partial shaft 16 in the coupling cavity 31. The sealing device 30 is formed of several sealing elements.

The coupling housing 28 is separate from the device housing 2, wherein the coupling housing 28 and the device housing 2 are detachably connected in a non-destructive manner. The connection is made by four screw connections, wherein the corresponding threads are formed in the second housing end segment 9. The coupling housing 28 is designed and arranged on the device housing 2 in such a manner that, when the coupling housing 28 is demounted, the second partial shaft 16 can be demounted from the first partial shaft 15 and mounted on the first partial shaft 15.

The descaling device 1 has a motor 32 designed as an electric motor. During operation of the descaling device 1, the motor 32 generates the rotary movement of the shaft 3 and, for this, is arranged on the shaft 3 in the housing interior 11 of the device housing 2 between the nozzle head 5 and the medium coupling 6. In particular, the motor 32 is also arranged between the first bearing 13 and the second bearing 14. The device housing 2 hermetically encloses the motor 32. The motor 32 has a rotor 33 and a stator 34. The rotor 33 is arranged on the shaft 3 in the form of the first partial shaft 15 and the stator 34 is arranged in the housing interior 11 on the device housing 2. The motor 32, which is designed as an electric motor, is an asynchronous motor with six pole pairs.

Cooling channels 35 are formed in the device housing 2 and the device housing 2 is also designed to transfer heat generated during operation from the motor 32 and radiant heat from a hot workpiece arranged in front of the nozzle head 5 to a medium present in the cooling channels 35. For this reason, cooling channels 35, in particular, are formed in the part of the device housing 2, namely the first housing end segment 8, which is next to the hot workpiece. The medium present in the cooling channels, for example, is a medium 21 used for descaling.

What is claimed is:

1. A descaling device, comprising:

a device housing, a shaft, a shaft bearing, a motor, a nozzle head, and a medium coupling, wherein the shaft bearing is arranged in the device housing and the shaft is mounted in the device housing by the shaft bearing for carrying out a rotary movement, wherein the shaft and the nozzle head are detachably connected to one another in a non-destructive manner, wherein the medium coupling has a medium connection for supplying a medium, wherein the shaft has a shaft cavity for conducting the medium supplied at the medium connection to the nozzle head, wherein the motor is arranged on the shaft in the device housing between the nozzle head and the medium coupling in order to generate rotary movement of the shaft, wherein the shaft has a first partial shaft and a second partial shaft, the first partial shaft and the second partial shaft being detachably connected to one another in a non-destructive manner, wherein the first partial shaft is connected to the nozzle head, and wherein the shaft bearing is arranged exclusively on the first partial shaft, and wherein the medium coupling is arranged on the second partial shaft, the first partial shaft and the second partial shaft each have a blind hole with an open end and a closed end, and wherein the blind hole of the first partial shaft and the blind hole of the second partial shaft together form the shaft cavity.

2. The descaling device according to claim 1, wherein the medium coupling has a coupling housing, a cover and a sealing device, wherein the coupling housing has a coupling cavity, wherein the cover is detachably connected to the coupling housing in a non-destructive manner and seals the coupling cavity, wherein the sealing device is located in the coupling cavity between the shaft and the medium connection for sealing, and wherein the medium coupling and the shaft are configured to enable the sealing device to be removed and inserted with the cover removed.

3. The descaling device according to claim 2, wherein the coupling housing is separate from the device housing and wherein the coupling housing and the device housing are detachably connected to one another in a non-destructive manner.

4. The descaling device according to claim 1, wherein the device housing hermetically encloses the motor.

5. The descaling device according to claim 1, wherein the motor is an electric motor.

6. The descaling device according to claim 1, wherein the coupling housing is separate from the device housing and wherein the coupling housing and the device housing are detachably connected to one another in a non-destructive manner, wherein the coupling housing is designed and arranged on the device housing in such a manner that, when the coupling housing is demounted, the second partial shaft can be demounted from the first partial shaft and mounted on the first partial shaft.

7. The descaling device according to claim 1, wherein cooling channels are formed in the device housing, and wherein the device housing is able to transfer heat from the motor produced during operation and/or radiant heat from a workpiece to a medium present in the cooling channels.

8. The descaling device according to claim 1, wherein the motor is configured for transferring heat generated by the motor during operation to a medium present in the shaft cavity.

9. The descaling device according to claim 1, wherein the nozzle head has a nozzle head carrier and a nozzle carrier, wherein at least one nozzle for expelling a medium is arranged in the nozzle carrier, wherein at least one channel is formed in the nozzle head carrier for conducting the medium from the shaft cavity to the at least one nozzle, wherein the nozzle carrier and the nozzle head carrier are detachably connected to one another in a non-destructive manner, and wherein the nozzle head carrier and the shaft are connected to one another.

* * * * *